US010694809B2

(12) United States Patent
Beamon, III

(10) Patent No.: US 10,694,809 B2
(45) Date of Patent: Jun. 30, 2020

(54) PROTECTIVE BOOT ASSEMBLY

(71) Applicant: Robert Beamon, III, Waterbury, CT (US)

(72) Inventor: Robert Beamon, III, Waterbury, CT (US)

( * ) Notice: Subject to any disclaimer, the term of this patent is extended or adjusted under 35 U.S.C. 154(b) by 219 days.

(21) Appl. No.: 15/883,224

(22) Filed: Jan. 30, 2018

(65) Prior Publication Data

US 2019/0231025 A1 Aug. 1, 2019

(51) Int. Cl.

| | |
|---|---|
| ***A43B 7/32*** | (2006.01) |
| ***A43B 5/00*** | (2006.01) |
| ***A63B 71/12*** | (2006.01) |
| ***A43B 3/02*** | (2006.01) |
| ***A63B 69/00*** | (2006.01) |

(52) U.S. Cl.

CPC ..... *A43B 7/32* (2013.01); *A43B 3/02* (2013.01); *A43B 5/00* (2013.01); *A63B 69/004* (2013.01); *A63B 71/1225* (2013.01); *A63B 2071/1258* (2013.01); *A63B 2071/1283* (2013.01); *A63B 2209/10* (2013.01); *A63B 2209/14* (2013.01)

(58) Field of Classification Search

CPC ..... A43B 7/32; A43B 5/00; A63B 69/004; A63B 71/1225; A63B 2071/1283

See application file for complete search history.

(56) References Cited

U.S. PATENT DOCUMENTS

| | | | | | |
|---|---|---|---|---|---|
| 2,657,477 | A * | 11/1953 | Winslow | A43B 3/20 | 36/2 R |
| 3,667,140 | A | 6/1972 | Hunderford | | |
| 4,008,531 | A | 2/1977 | Schonbrun | | |
| 4,051,613 | A | 10/1977 | Collins | | |
| 4,361,912 | A * | 12/1982 | Arthur | A63B 69/004 | 2/18 |
| 4,397,105 | A | 8/1983 | Richardson | | |
| 4,624,015 | A * | 11/1986 | Bottoms | A43B 5/00 | 36/72 R |
| 5,070,630 | A * | 12/1991 | Edmundson | A43B 3/00 | 36/1.5 |
| 5,211,672 | A * | 5/1993 | Andujar | A43B 5/00 | 36/106 |
| 6,412,114 | B1 | 7/2002 | Carlin | | |
| D659,370 | S | 5/2012 | Spring | | |
| 2012/0180183 | A1* | 7/2012 | Mechling | A41D 13/0543 | 2/22 |
| 2013/0198922 | A1* | 8/2013 | Wittman | A41D 13/0543 | 2/22 |

FOREIGN PATENT DOCUMENTS

| | | |
|---|---|---|
| WO | WO2008070493 | 6/2008 |

* cited by examiner

*Primary Examiner* — Ted Kavanaugh

(57) ABSTRACT

A protective boot assembly for protecting feet and legs during combat sports includes a pair of boots. Each of the boots is worn during combat sports thereby facilitating a foot and a shin to be protected when receiving kicks and when delivering kicks. Each of the boots has a substantially open sole and an open calf.

4 Claims, 8 Drawing Sheets

PROTECTIVE BOOT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to boot devices and more particularly pertains to a new boot device for protecting feet and legs during combat sports.

BRIEF SUMMARY OF THE INVENTION

An embodiment of the disclosure meets the needs presented above by generally comprising a pair of boots. Each of the boots is worn during combat sports thereby facilitating a foot and a shin to be protected when receiving kicks and when delivering kicks. Each of the boots has a substantially open sole and an open calf.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
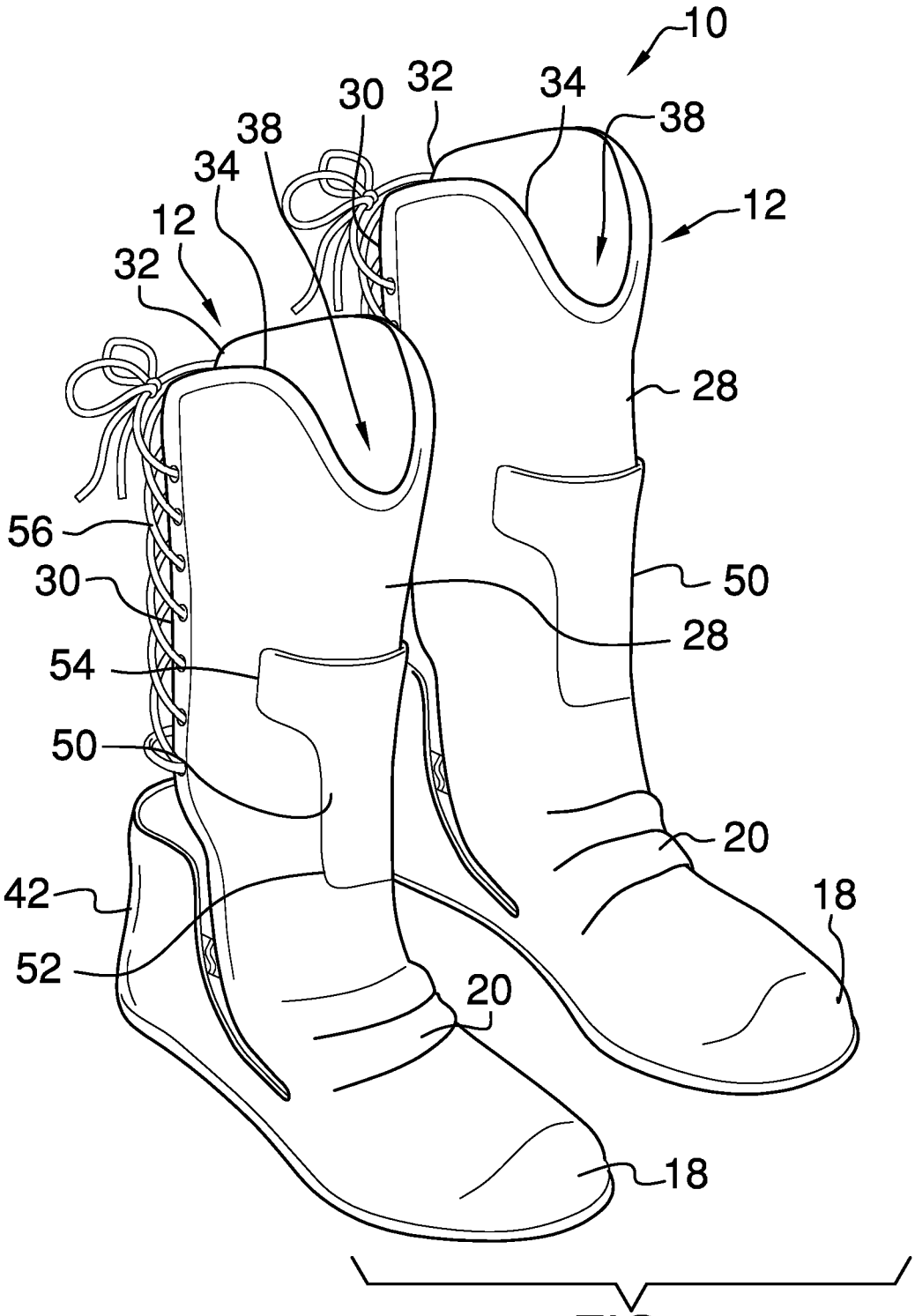
FIG. 1 is a front perspective view of a protective boot assembly according to an embodiment of the disclosure.
Figure 2:
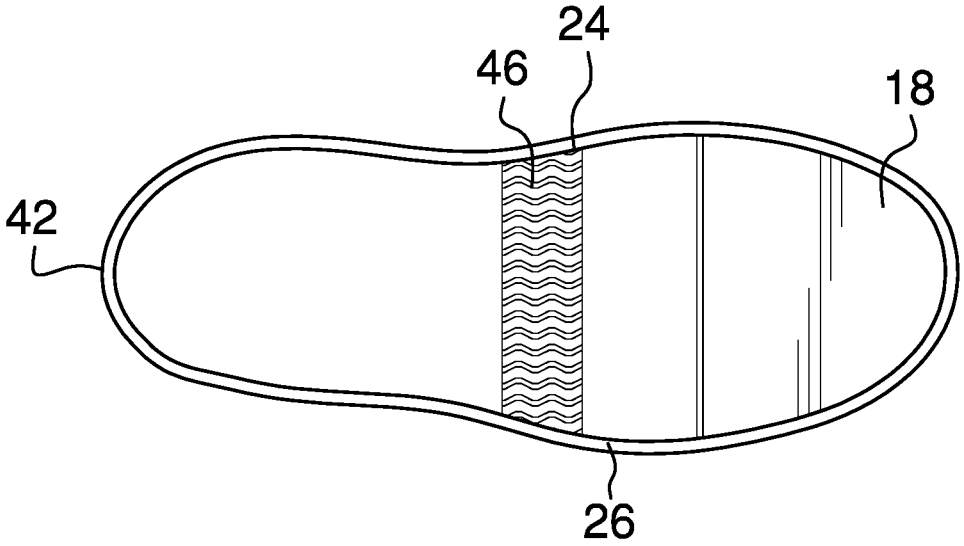
FIG. 2 is a bottom view of an embodiment of the disclosure.
Figure 3:
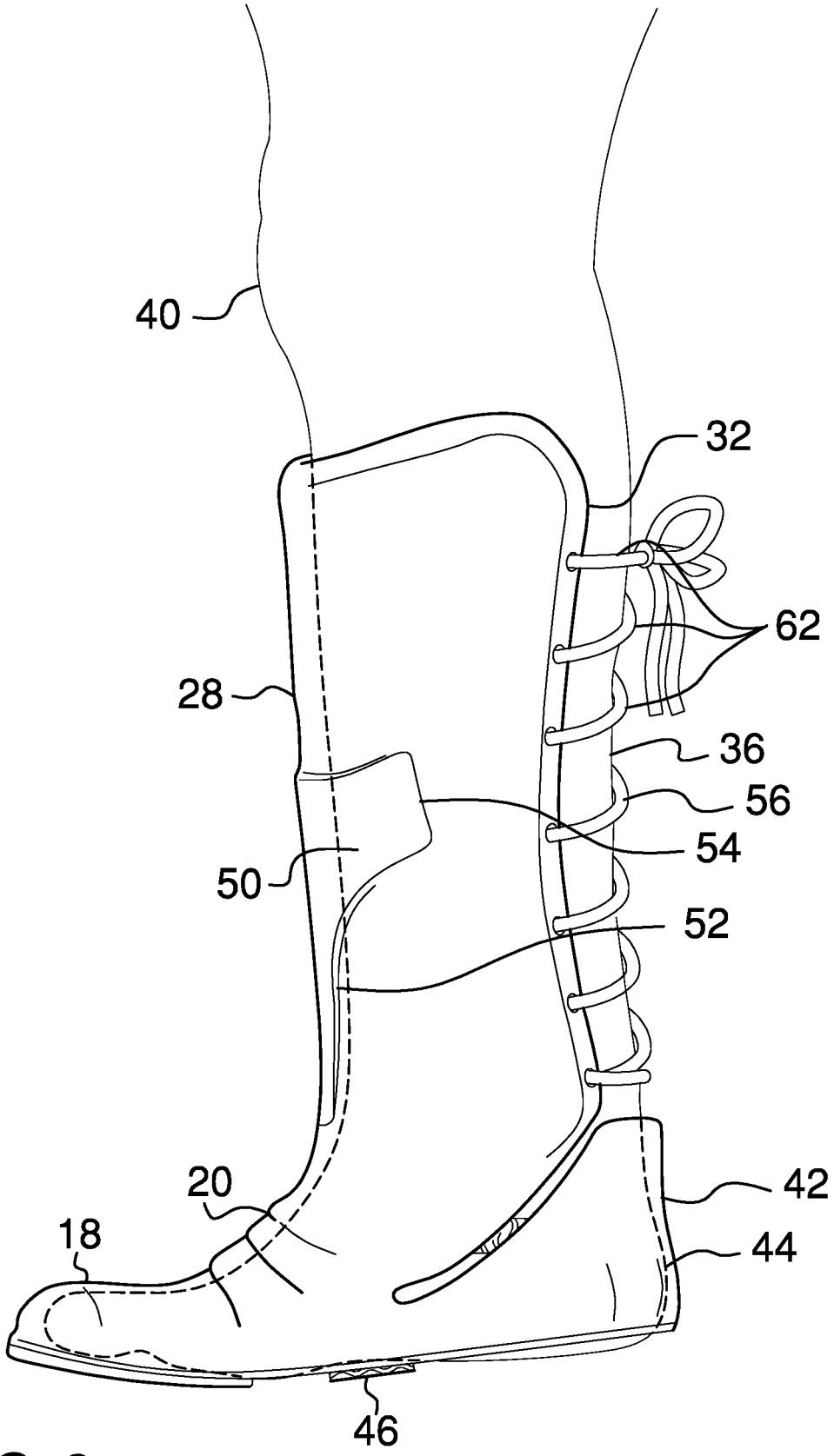
FIG. 3 is a perspective in-use view of an embodiment of the disclosure.
Figure 4:
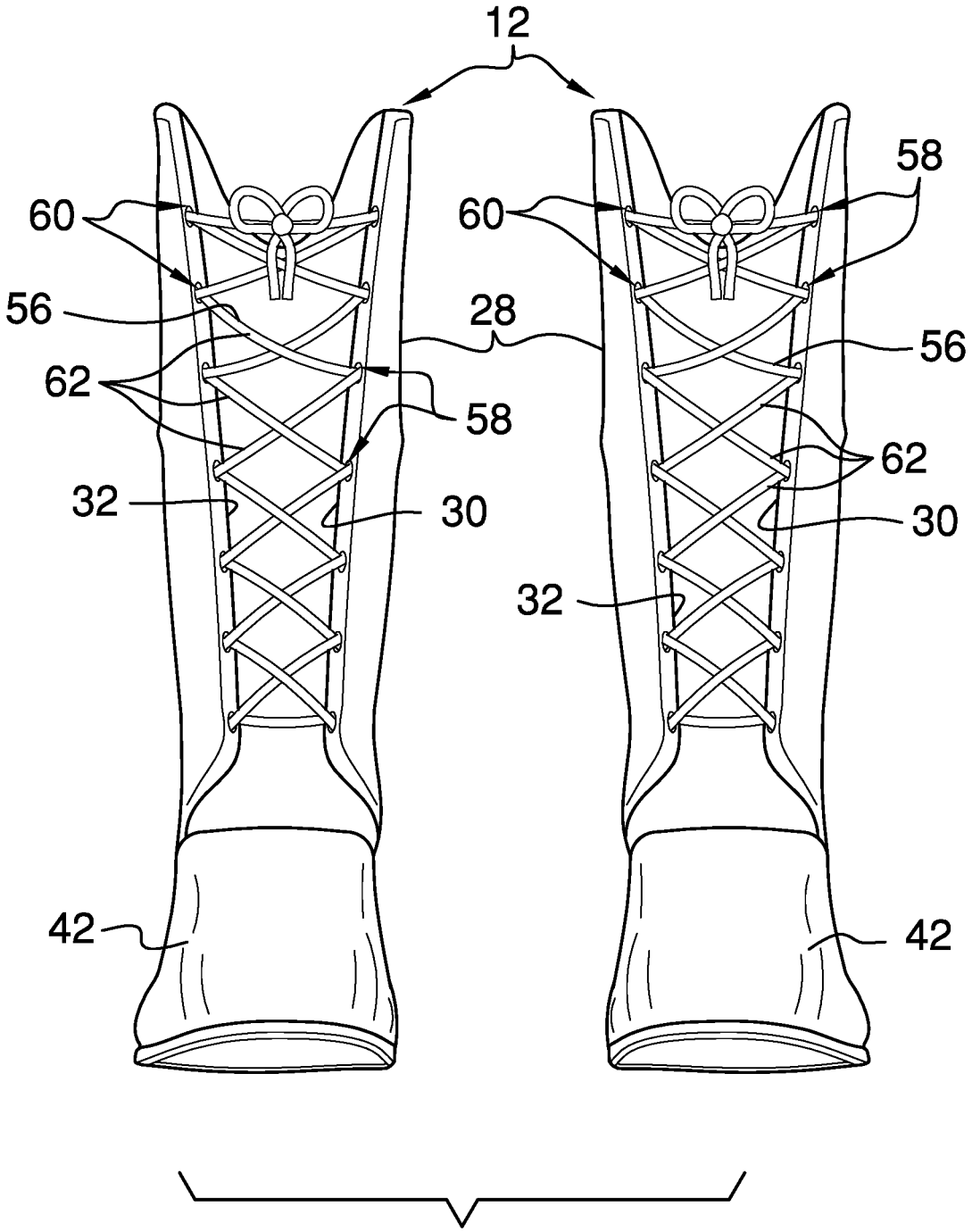
FIG. 4 is a back view of an embodiment of the disclosure.
Figure 5:
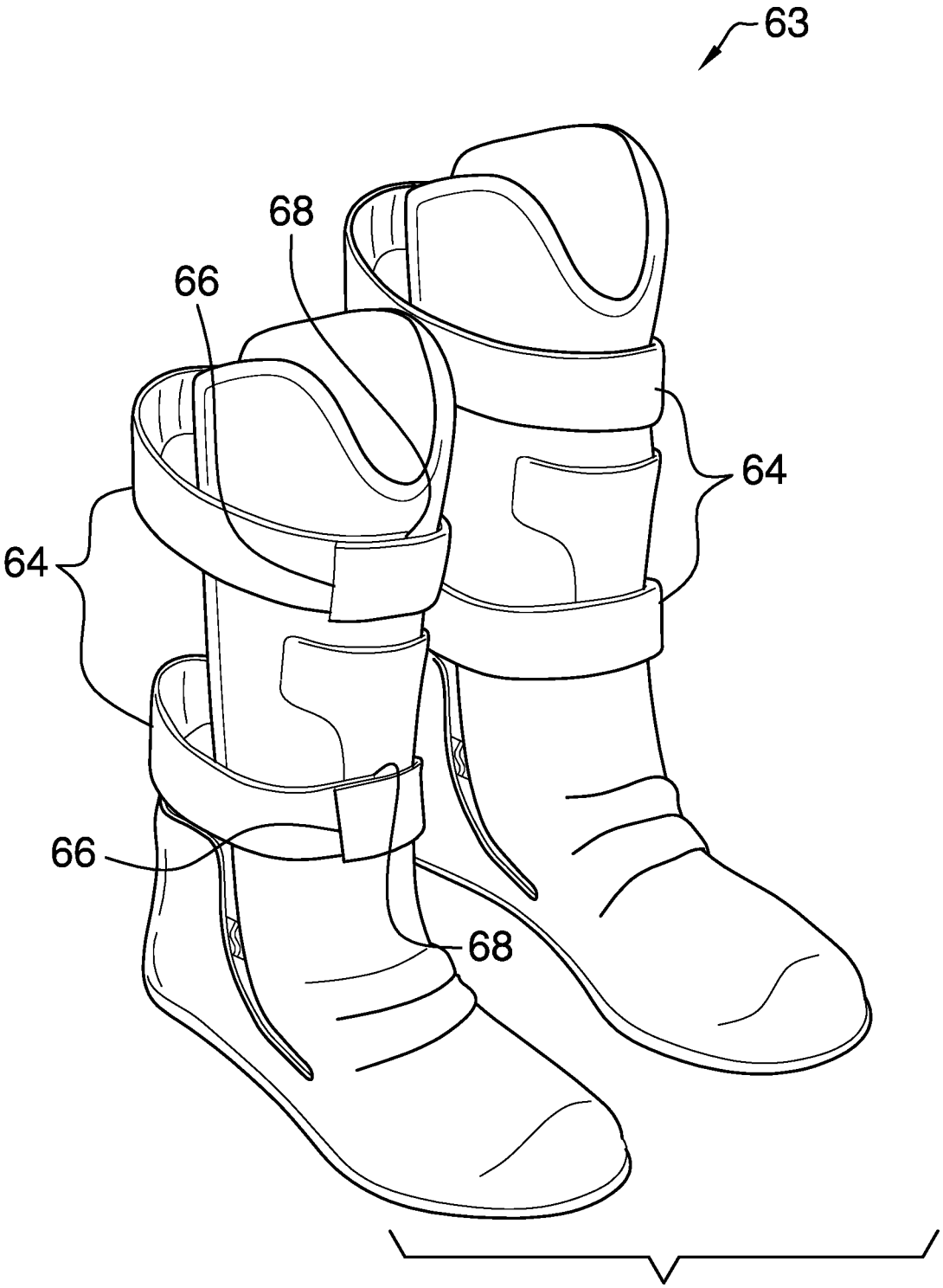
FIG. 5 is a front perspective view of an alternative embodiment of the disclosure.
Figure 6:
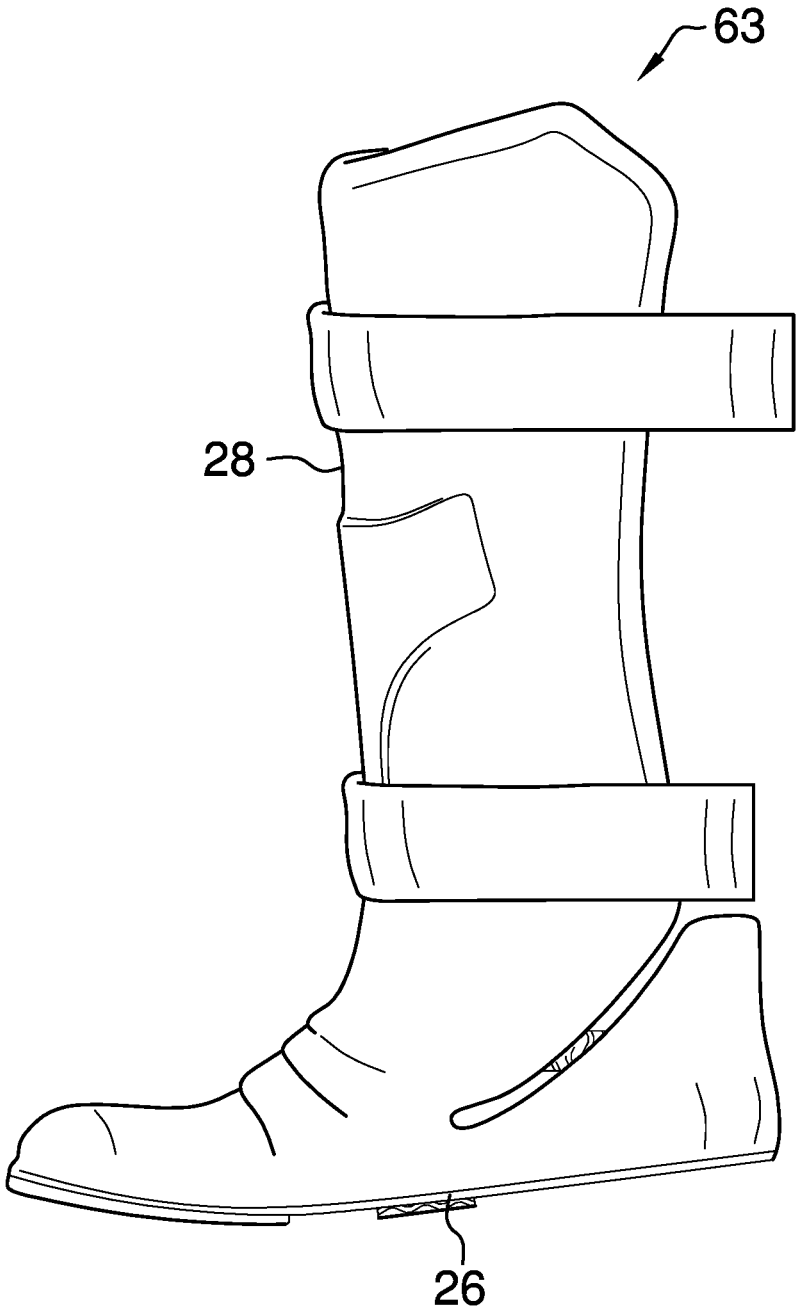
FIG. 6 is a left side view of an alternative embodiment of the disclosure.
Figure 7:
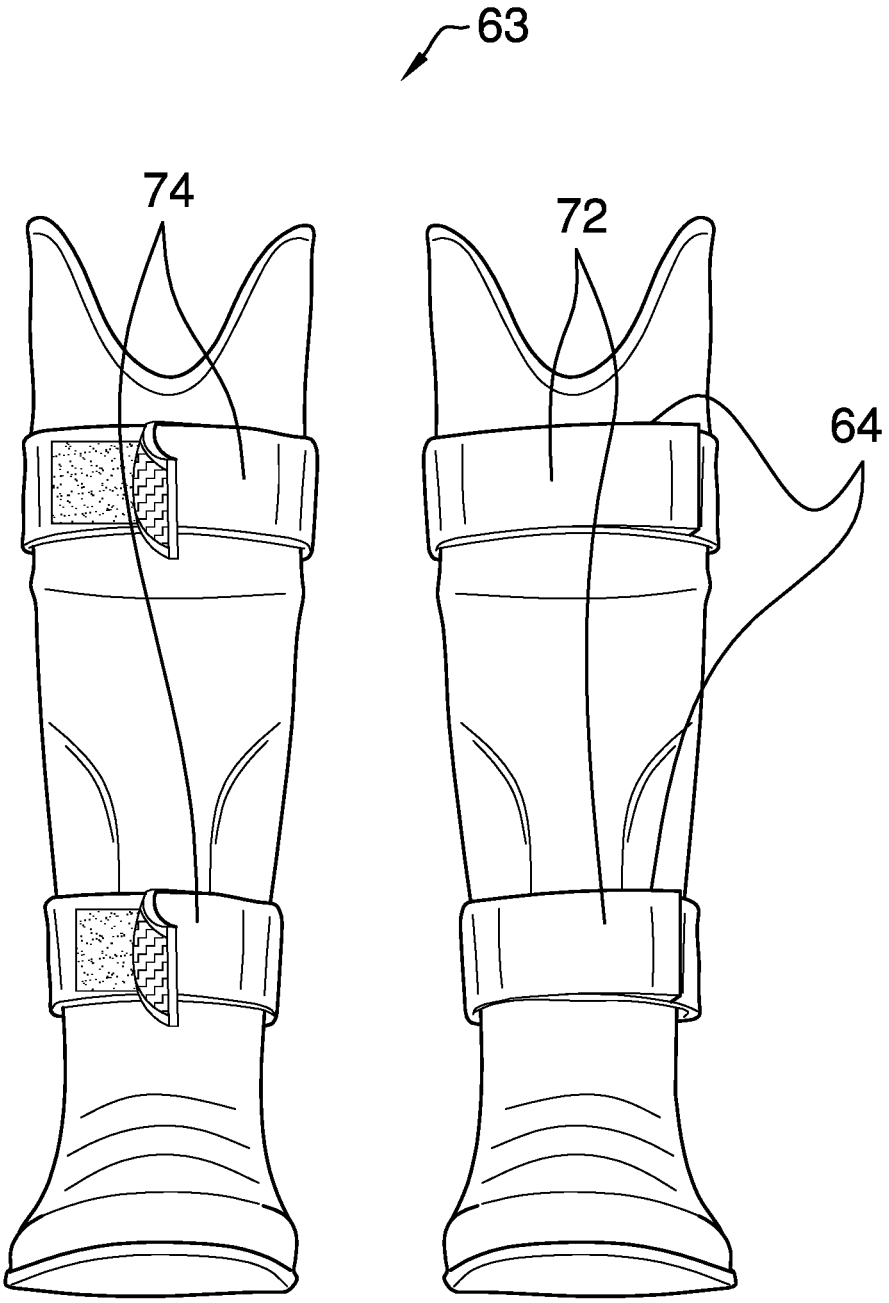
FIG. 7 is a front view of an alternative embodiment of the disclosure.
Figure 8:
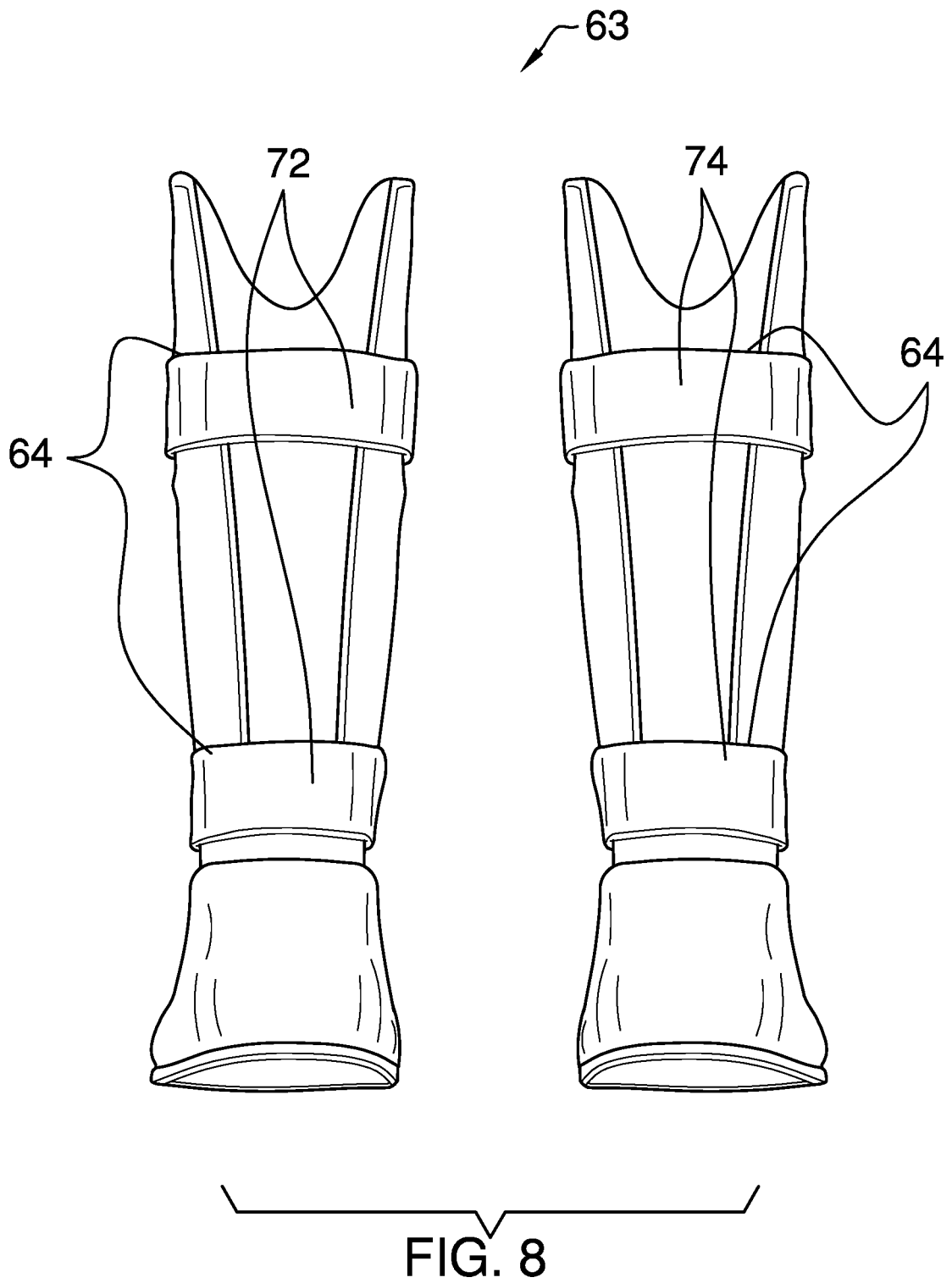
FIG. 8 is a back view of an alternative embodiment of the disclosure.

With reference now to the drawings, and in particular to FIGS. 1 through 8 thereof, a new boot device embodying the principles and concepts of an embodiment of the disclosure and generally designated by the reference numeral 10 will be described.

As best illustrated in FIGS. 1 through 8, the protective boot assembly 10 generally comprises a pair of boots 12 that may each be worn during combat sports. Moreover, the boots 12 protects a foot 14 and a shin 16 when receiving kicks and when delivering kicks related to the combat sport. Each of the boots 12 has a substantially open sole and an open calf. The combat sport may be Muay Thai kickboxing, Jeet Kune Do or any other combat sport involving kicks.

Each of the boots 12 has a toe box 18 and a vamp 20 extending rearwardly therefrom. The vamp 20 covers a top side 22 of a foot 14 when the boots 12 are worn. The vamp 20 corresponding to each of the boots 12 has first lateral edge 24 and a second lateral edge 26. Moreover, the vamp 20 corresponding to each of the boots 12 is concavely arcuate between each of the first lateral edge 24 and the second lateral edge 26.

Each of the boots 12 has a front quarter 28 extending upwardly from the vamp 20 to cover a shin 16 when the boots 12 are worn. The front quarter 28 corresponding to each of the boots 12 has a first edge 30, a second edge 32 and a top edge 34. The front quarter 28 corresponding to each of the boots 12 is concavely arcuate between the first edge 30 and the second edge 32. In this way the front quarter 28 corresponding to each of the boots 12 substantially wraps around a lower leg 36 when the boots 12 are worn.

The top edge 34 curves downwardly between the first edge 30 and the second edge 32 to define a knee space 38. The knee space 38 is positioned below a knee 40 when the boots 12 are worn. In this way the front quarter 28 does not inhibit bending the knee 40 when the boots 12 are worn. The front quarter 28 corresponding to each of the boots 12 has an outside surface 42.

Each of the boots 12 has a foxing 42 extending rearwardly and upwardly from the vamp 20. The foxing 42 corresponding to each of the boots 12 extends around a heel 44 when the boots 12 are worn. Moreover, the foxing 42 corresponding to each of the boots 12 is spaced from the first edge 30 and the second edge 32 of the front quarter 28 of the corresponding boot 12.

Each of the boots 12 further includes a strap 46 that is coupled between the first lateral edge 24 and the second lateral edge 26 of the vamp 20. The strap 46 extends along a bottom 48 of a foot 14 when the corresponding boot 12 is worn. The strap 46 is spaced from the toe box 18 and the strap 46 may be comprised of a resiliently stretchable material.

A pad 50 is coupled to the outside surface 42 of the front quarter 28. The pad 50 is comprised of a resiliently compressible material to protect the shin 16 from impact. The pad 50 may have a central portion 52 and a top portion 54 that is oriented transverse with the central portion 52. The top portion 54 may be horizontally oriented on the front quarter 28.

A plurality of fasteners 56 is provided. Each of the fasteners 56 is coupled between the first edge 30 and the second edge 32 of the front quarter 28 and each of the fasteners 56 is selectively manipulated. The fasteners 56 are spaced apart from each other and are distributed along the front quarter 28. The plurality of fasteners 56 tightens the front quarter 28 on the lower leg 36 to retain the boots 12 on the lower leg 36.

As shown in FIGS. 1 through 4, the front quarter 28 has a plurality of first apertures 58 extending therethrough. The first apertures 58 are spaced apart from each other and are distributed along the first edge 30. The front quarter 28 has a plurality of second apertures 60 extending therethrough. The second apertures 60 are spaced apart from each other and are distributed along the second edge 32. Further, the fasteners 56 as shown in FIGS. 1 through 4 comprise a plurality of lacings 62 that are extended through each of the first fasteners 56 and the second fasteners 56. The lacings 62 are selectively manipulated to tighten the front quarter 28 around the lower leg 36.

In an alternative embodiment 63 as shown in FIGS. 5 through 8, the plurality of fasteners 56 comprises a plurality of straps 64. Each of the plurality of straps 64 has a first end 66 and a second end 68. Moreover, the first end 66 corresponding to each of the straps 64 is matable to the second end 68 of the corresponding strap 46. Each of the straps 64 may be matable to each other with a complementary pair of hook and loop fasteners or the like.

The plurality of straps 46 includes a set of first straps 72 and a set of second straps 74. Each of the first straps 72 is positioned around the front quarter 28 of an associated one of the boots 12. Each of the first straps 72 forms a closed loop to tighten the associated front quarter 28 around the lower leg 36. Each of the second straps 74 is positioned around the front quarter 28 of an associated one of the boots 12. Moreover, each of the second straps 74 forms a closed loop to tighten the associated front quarter 28 around the lower leg 36.

In use, each of the boots 12 is worn during combat sports. Toes are positioned within the toe box 18 when the boots 12 are worn. The strap 46 corresponding to each of the boots 12 extends along the bottom of the foot 14 when the boots 12 are worn. The foxing 42 corresponding to each of the boots 12 surrounds the heel 44 when the boots 12 are worn. The plurality of fasteners 56 is manipulated to tighten the front quarter 28 corresponding to each of the boots 12 around the associated lower leg 36. The pad 50 corresponding to each of the boots 12 absorbs impact energy from delivering kicks and blocking kicks.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A protective boot assembly being configured to be worn during combat sports thereby facilitating a foot and a shin to be protected, said assembly comprising:

a pair of boots, each of said boots being configured to be worn during combat sports thereby facilitating a foot and a shin to be protected when receiving kicks and when delivering kicks, each of said boots having a toe box and a vamp extending rearwardly therefrom wherein said vamp is configured to cover a top side of a foot when said boots are worn, said vamp corresponding to each of said boots having first lateral edge and a second lateral edge, said vamp corresponding to each of said boots being concavely arcuate between each of said first lateral edge and said second lateral edge, said first lateral edge and said second lateral edge being spaced and defining an open sole therebetween, wherein a substantial portion of the foot is exposed at the open sole, each of said boots having a front quarter extending upwardly from said vamp wherein said front quarter is configured to cover a shin when said boots are worn, said front quarter corresponding to each of said boots having a first edge and a second edge, said front quarter corresponding to each of said boots being concavely arcuate between said first edge and said second edge wherein said front quarter corresponding to each of said boots is configured to substantially wrap around a lower leg when said boots are worn, said first edge and said second edge being spaced and defining an opening, the opening configured to substantially expose a calf of the wearer, said front quarter corresponding to each of said boots having an outside surface; and a strap being coupled between said first lateral edge and said second lateral edge of said vamp wherein said strap extends across said open space therebetween and is configured to extend along a bottom of a foot when said corresponding boot is worn, said strap being spaced from said toe box; and further comprising each of said boots having a foxing extending rearwardly and upwardly from said vamp wherein said foxing corresponding to each of said boots is configured to extend around a heel when said boots are worn, said foxing corresponding to each of said boot being spaced from said first edge and said second edge of said front quarter of said corresponding boot.

2. The assembly according to claim 1, further comprising a pad being coupled to said outside surface of said front quarter, said pad being comprised of a resiliently compressible material wherein said pad is configured to protect the shin from impact.

3. The assembly according to claim 1, further comprising a plurality of fasteners, each of said fasteners being coupled between said first edge and said second edge of said front quarter wherein each of said fasteners is configured to be manipulated, said fasteners being spaced apart from each other and being distributed along said front quarter wherein said plurality of fasteners is configured to tighten said front quarter on the lower leg.

4. A protective boot assembly being configured to be worn during combat sports thereby facilitating a foot and a shin to be protected, said assembly comprising:

a pair of boots, each of said boots being configured to be worn during combat sports thereby facilitating a foot and a shin to be protected when receiving kicks and when delivering kicks, each of said boots having a toe box and a vamp extending rearwardly therefrom wherein said vamp is configured to cover a top side of a foot when said boots are worn, said vamp corresponding to each of said boots having first lateral edge and a second lateral edge, said vamp corresponding to each of said boots being concavely arcuate between each of said first lateral edge and said second lateral edge, said first lateral edge and said second lateral edge being spaced and defining an open sole therebetween, wherein a substantial portion of the foot is exposed at the open sole, each of said boots having a front quarter extending upwardly from said vamp wherein said front quarter is configured to cover a shin when said boots are worn, said front quarter corresponding to each of said boots having a first edge and a second edge, said front quarter corresponding to each of said boots being concavely arcuate between said first edge and said second edge wherein said front quarter corresponding to each of said boots is configured to substantially wrap around a lower leg when said boots are worn, said first edge and said second edge being spaced and defining an opening, the opening configured to substantially expose a calf of the wearer, said front quarter corresponding to each of said boots having an outside surface, each of said boots having a foxing extending rearwardly and upwardly from said vamp wherein said foxing corresponding to each of said boots is configured to extend around a heel when said boots are worn, said foxing corresponding to each of said boots being spaced from said first side and said second side of said front quarter of said corresponding boot; and each of said boots further comprising:

a strap being coupled between said first lateral edge and said second lateral edge of said vamp wherein said strap extends across said open space therebetween and is configured to extend along a bottom of a foot when said corresponding boot is worn, said strap being spaced from said toe box, said strap being spaced from said toe box, a pad being coupled to said outside surface of said front quarter, said pad being comprised of a resiliently compressible material wherein said pad is configured to protect the shin from impact, and a plurality of fasteners, each of said fasteners being coupled between said first edge and said second edge of said front quarter wherein each of said fasteners is configured to be manipulated, said fasteners being spaced apart from each other and being distributed along said front quarter wherein said plurality of fasteners is configured to tighten said front quarter on the lower leg; and further comprising each of said boots having a foxing extending rearwardly and upwardly from said vamp wherein said foxing corresponding to each of said boots is configured to extend around a heel when said boots are worn, said foxing corresponding to each of said boot being spaced from said first edge and said second edge of said front quarter of said corresponding boot.

* * * * *